United States Patent [19]

Noeske

[11] 4,041,263

[45] Aug. 9, 1977

[54] ELECTRIC CIRCUIT INTERRUPTER OF THE PUFFER TYPE COMPRISING A MAGNETICALLY ACTUATED PISTON

[75] Inventor: Heinz O. Noeske, Cherry Hill, N.J.

[73] Assignee: General Electric Company, Philadelphia, Pa.

[21] Appl. No.: 607,084

[22] Filed: Aug. 22, 1975

[51] Int. Cl.[2] ..... H01H 33/20

[52] U.S. Cl. ..... 200/148 A; 200/147 R; 200/150 G

[58] Field of Search ..... 200/148 A, 150 G, 147 R

[56] References Cited

U.S. PATENT DOCUMENTS

| | | | |
|---|---|---|---|
| 3,331,935 | 7/1967 | Milianowicz | 200/148 A |
| 3,524,958 | 8/1970 | Frink | 200/148 A |
| 3,551,625 | 12/1970 | Fischer | 200/148 A |
| 3,551,626 | 12/1970 | Milianowicz | 200/148 A |
| 3,721,786 | 3/1973 | Yoshioka | 200/148 A |
| 3,745,281 | 7/1973 | Yoshioka | 200/148 A |

*Primary Examiner*—Robert S. Macon
*Attorney, Agent, or Firm*—William Freedman

[57] ABSTRACT

A puffer-type circuit interrupter comprises a cylinder coupled to the conductive contact rod of the interrupter and a floating piston within the cylinder that is relatively movable with respect to the cylinder to pressurize fluid in the cylinder, which pressurized fluid is used for arc-extinguishing purposes. Means effective during an interrupting operation is provided for forcing current flowing through the rod to follow a loop-shaped path, electrically in series with the rod, that extends through the piston. This current has a magnetic effect while flowing through said loop-shaped path that acts to drive the piston within the cylinder through a fluid-pressurizing operation.

13 Claims, 15 Drawing Figures

ELECTRIC CIRCUIT INTERRUPTER OF THE PUFFER TYPE COMPRISING A MAGNETICALLY ACTUATED PISTON

BACKGROUND

This invention relates to an electric circuit interrupter of the puffer type and, more particularly, to a circuit interrupter of this type which comprises a floating piston that is magnetically driven during a circuit-interrupting operation to pressurize fluid that is subsequently directed into the arcing zone to aid in arc-extinction.

Circuit interrupters of the puffer type utilize a cooperating cylinder and piston as a means for compressing gas which is subsequently directed into the arcing zone to aid in arc-extinction. In one typical puffer-type circuit interrupter design, the cylinder is coupled to the usual operating rod for the movable contact of the circuit interrupter, and relative movement between the cylinder and piston is effected by movement of the operating rod. It has been recognized that such designs are usually rather slow in effecting circuit interruption of high currents because a relatively large travel of the operating rod is usually required before the pressure in the cylinder is increased to the high value desired for effective high-current circuit interruption.

To overcome this problem it has been proposed to make the piston a floating piston provided with its own driving means for accelerating the gas-compression operation. In U.S. Pat. No. 3,331,935—Milianowicz, this separate driving means compises a latched compression spring which is suitably released early in the interrupting operation. In U.S. Pat. No. 3,721,786—Yoshioka (FIG. 6) the separate driving means comprises an electromagnet having an armature coupled to the floating piston and magnetically driven by a repulsion force when the coil of the electro-magnet is energized.

A disadvantage of the latter circuit interrupter is that the force on the floating piston depends upon the position of the piston and after an initial increase drops rapidly as the armature moves away from the coil of the electromagnet.

SUMMARY

An object of my invention is to provide a puffer-type circuit interrupter having a floating piston operated by new and improved magnetic means.

Another object is to provide magnetic means for operating such a floating piston which provides a force on the piston that remains high irrespective of the position of the piston as it moves through its stroke.

Another object is to provide magnetic means of the type set forth in the immediately preceding object which is also effective to apply to the contact-operating rod a force to assist in driving the contact-operating rod open, which force is largely unaffected by change is position of the contact-operating rod.

In carrying out the invention in one form, I provide a movable conductive rod on which one of the separable contacts of the interrupter is mounted. A cylinder has an end wall coupled to this rod, and within the cylinder is a piston for pressurizing fluid within the cylinder when the piston is moved relative to and toward the end wall. Means is provided for conveying this pressurized fluid from the cylinder to the inter-contact space upon contact-separation. First tubular conductive structure surrounds the conductive rod, and second tubular conductive structure surrounds the first tubular conductive structure. The piston has a portion forming an electrical connection between the first and second tubular structures and is movable with respect to said tubular structures. Conductive bridging structure extends between and electrically interconnects the conductive rod and the second tubular structure. Means effective during a contact-separating operation is provided for forcing current flowing through said conductive rod to follow a loop-shaped path that extends in series through said rod, said bridging structure, said second tubular conductive structure, said piston portion, and said first tubular conductive structure. The instantaneous current in said path flows through said first tubular structure and said rod in a first direction longitudinally of said rod and flows through said second tubular structure in a second direction longitudinally of said rod which is generally opposite to said first direction. The magnetic effect of current through said loop-shaped path via said piston portion acts to drive said piston toward said cylinder end wall, thereby pressurizing fluid within said cylinder.

BRIEF DESCRIPTION OF DRAWINGS

For a better understanding of the invention, reference may be had to the accompanying drawings, wherein.

DETAILED DESCRIPTION OF PREFERRED EMBODIMENTS

Figure 1:
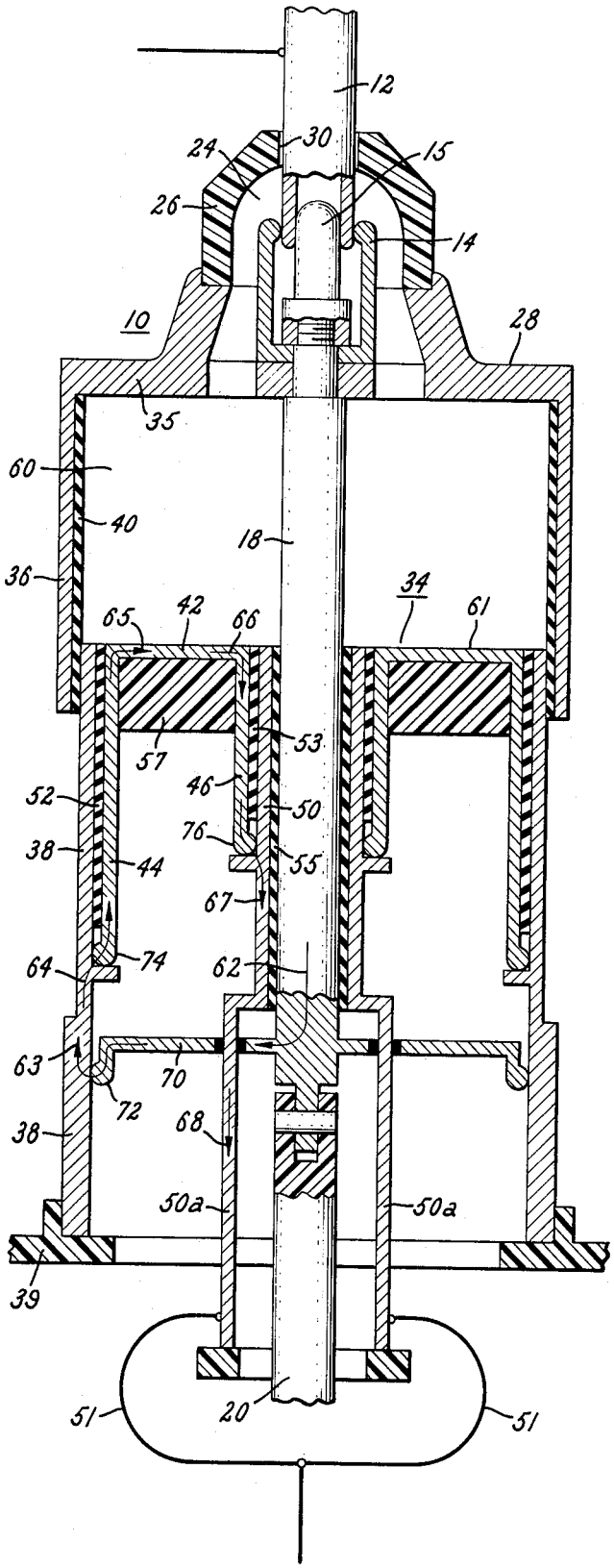
FIG. 1 is a cross-sectional view of a circuit interrupter, shown in closed position, embodying one form of the present invention.
Figure 1A:
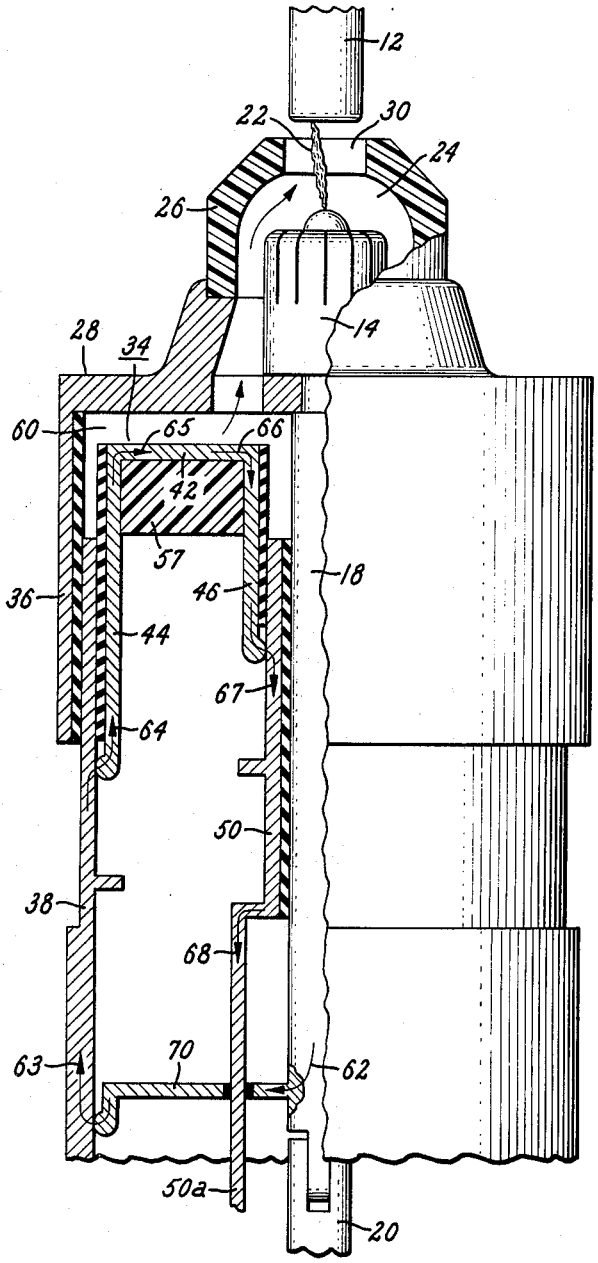
FIG. 1A is a partially sectional view of the interrupter of FIG. 1, shown during an interrupting operation.

Embodiment of FIGS. 1 and 1A

Referring now to FIG. 1, there is shown a puffer-type circuit interrupter 10 that is located within a conventional housing (not shown) that is filled with a moderately pressurized arc-extinguishing gas, such as sulfur hexafluoride at a pressure of about 60 p.s.i. This gas surrounds the interrupter and is normally present within all open spaces within the interrupter, e.g., cylinder space 60 (soon to be described). The interrupter comprises a first contact 12 that is generally stationary and a second contact 14 that is vertically movable with respect to the first contact. In the illustrated embodiment, contact 12 is a tubular rod, and contact 14 comprises a plurality of conductive fingers forming an annular cluster that embraces the rod-type stationary contact 12 when the circuit interrupter is closed, as shown in FIG. 1. A centrally disposed arcing electrode 15 is carried by movable contact 14 and extends into the bore of stationary contact 12 when the circuit interrupter is closed. Contacts 12 and 14 are of a conventional design, and a more detailed description of them is therefore considered unnecessary.

For actuating the movable contact 14, a vertically extending conductive contact rod 18 is provided. The upper end of this contact rod is suitably connected to the movable contact 14 to provide a good mechanical connection and a high conductivity joint therebetween. The lower end of contact rod 18 is mechanically connected to an insulating operating rod 20 which, in turn, is connected to an operating mechanism (not shown). Circuit breaker opening is effected by driving operating rod 20 from its position of FIG. 1 downwardly through its position illustrated in FIG. 1A. This establishes between contacts 12 and 14 an electric arc 22, the lower terminal of which quickly transfers to the central arcing electrode 15.

To aid in extinguishing the arc, a blast of arc extinguishing gas is supplied from cylinder space 60 to the arcing zone through a passageway 24 in an insulating nozzle 26. This nozzle 26 is supported on a movable cylinder 28 that is mechanically connected to the movable contact rod 18 for movement therewith. There is a central orifice 30 in the nozzle that closely surrounds stationary contact rod 12. The nozzle 26 moves downward with movable contact 14 and contact rod 18 during a circuit-interrupting operation. During the initial portion of a circuit-interrupting operation, rod contact 12 remains within the orifice 30, but thereafter the orifice moves downwardly into and through the position depicted in FIG. 1A. While rod contact 12 is within orifice 30, the orifice is blocked and no substantial gas flow can occur through passageway 24. But when the nozzle 26 has moved downwardly sufficiently to unblock the orifice, a blast of pressurized arc-extinguishing gas flows from cylinder space 60 upwardly through passage 24 into the arcing region, exhausting through orifice 30 as shown in FIG. 1A. The resulting blast of arc extinguishing gas past the arc is relied upon to extinguish the arc.

For developing the above-described blast, I rely upon a puffer which comprises the above-mentioned cylinder 28 and a piston 34. Cylinder 28 has an upper end wall 35 suitably coupled to the contact rod 18 and a cylindical skirt 36 that surrounds and slidably receives the stationary tubular housing 38. The lower end of housing 38 is fixed to a stationary support 39. A lining 40 of a suitable insulating material having self-lubricating properties is disposed within the skirt 36 and bonded thereto so as to provide a seal between the skirt 36 and the housing 38, to reduce the friction therebetween, and to prevent significant current from flowing between the skirt 36 and housing 38. This lining can be of polytetrafluoroethylene, which is a material sold by du Pont under the trademark Teflon.

The piston 34 is a floating piston that comprises an upper end wall 42, a tubular outer wall 44, and a tubular inner wall 46. The tubular inner wall surrounds stationary tubular conductive structure 50 which, in turn, surrounds contact rod 18. Bonded to the outer surface of the tubular outer wall 44 of piston 34 is a coating 52 of self-lubricating insulating material, preferably Teflon, and bonded to the inner surface of tubular inner wall 46 is another coating 53 of the same self-lubricating insulating material. Between the tubular conductor 50 and the contact rod 18 there is also a tubular layer 55 of the same self-lubricating insulating material, which locally electrically insulates these two parts from each other and acts as a guide for contact rod 18.

Conductive support 50 comprises at its lower end a plurality of circumferentially spaced legs 50*a* extending in insulated relationship through openings in conductive bridging structure 70 of disc form carried by the contact rod 18.

Piston 34 is normally held in its depressed position of FIG. 1 by suitable biasing means. In the illustrated embodiment, this biasing means simply comprises a mass 57 of dense insulating material fixed to the bottom of the top wall 42 of the piston 34. Suitable spring means can be used instead of the mass 57 for biasing the spring into its position of FIG. 1.

When the contact rod 18 is driven downwardly during a circuit-interrupting operation, the cylinder 28 moves downwardly therewith to compress the gas present in the space 60 between the cylinder end wall 35 and the upper working face 61 of piston 34. When orifice 30 in nozzle 26 becomes unblocked following a short amount of initial contact movement, as described hereinabove, this compressed gas flows upwardly through passageways 24 to produce an arc-extinguishing effect. Under low current conditions, the piston 34 remains stationary while the above-described compression of gas in space 60 is occurring. Under high-current interrupting conditions, however, the piston 34 is magnetically driven upwardly concurrently with downward movement of the cylinder 28 to greatly accelerate the compression of gas in space 60.

This magnetic driving action is effected by directing the current that flows through contact rod 18 around a loop-shaped path indicated by arrows 62, 63, 64, 65, 66, 67, and 68 in sequence. The parts that constitute this path include the radially extending bridging disc 70 joined to contact rod 18, the tubular housing 38, the outer tubular wall 44 of the piston, piston end wall 42, the tubular inner wall 46 of the piston, tubular piston support 50, and the legs 50*a* of the tubular support. A terminal connection 51 is provided on these legs 50*a*. Suitable sliding contacts are provided between certain of the juxtaposed relatively movable parts in this path. More specifically, sliding contacts 72 are provided between parts 70 and 38, sliding contacts 74 between parts 38 and 44, and sliding contacts 76 between parts 46 and 50. These sliding contacts can be of any suitable conventional form and are therefore shown schematically only. Although the arrows 62–68 are shown in FIG. 1 only in a radially extending plane at the left hand side of contact rod 18, it is to be understood that similar loop-shaped paths are present in radial planes at substantially all points around the circumference of contact rod 18. The parts defining the above-described loop-shaped path may be thought of as forming a vertically extending coaxial conductor having two longitudinally spaced radially extending connections between the inner and outer conductors at upper and lower locations. The inner vertically extending coaxial conductor is constituted by the contact rod 18 and by the tubular support 50; the outer vertically extending coaxial conductor is constituted by the tubular metal housing 38; the upper radial connection is constituted by the end wall 42 of the piston; and the lower radial connection is constituted by the conductive bridging member 70. As will be apparent from the arrows 62–68, current in the loop-shaped circuit flows in one direction through the inner coaxial conductor 18, 50 and in an opposite direction through the outer coaxial conductor 38. (Through the inner conductor the current flows twice in one direction, once via contact rod 18 and once via tubular support 50.) The magnetic effect of current flowing in a circuit of such configuration is to drive the upper radially extending connection (i.e., piston end wall 42) upwardly and the lower radially extending connection (i.e., the bridging member 70) downwardly.

Figure 2B:
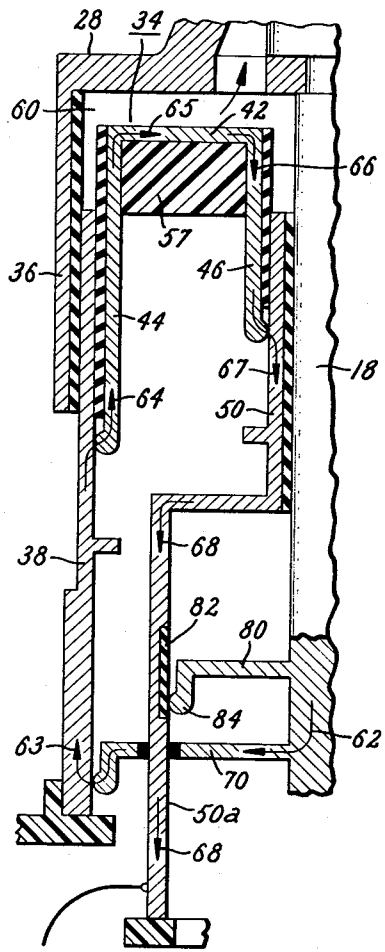
FIG. 2B shows the interrupter of FIG. 2 after additional contact-separating motion and after the floating piston has begun operation.
Figure 2A:
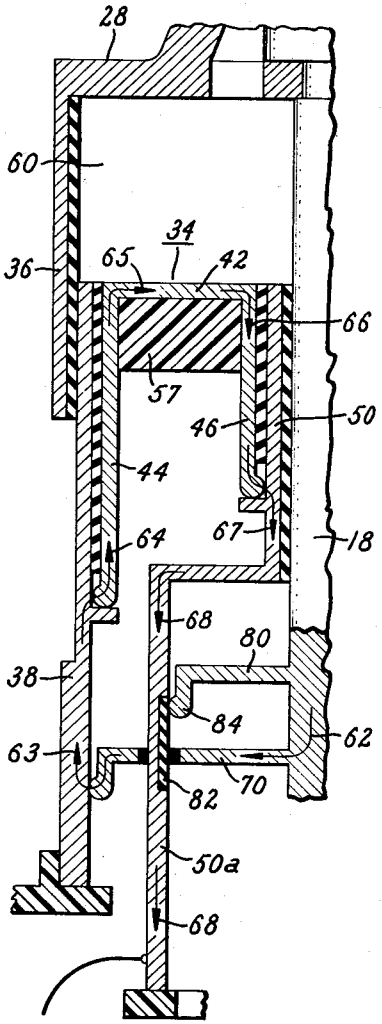
FIG. 2A shows the interrupter of FIG. 2 after initial contact-separating motion but prior to operation of the floating piston of the interrupter.
Figure 2:
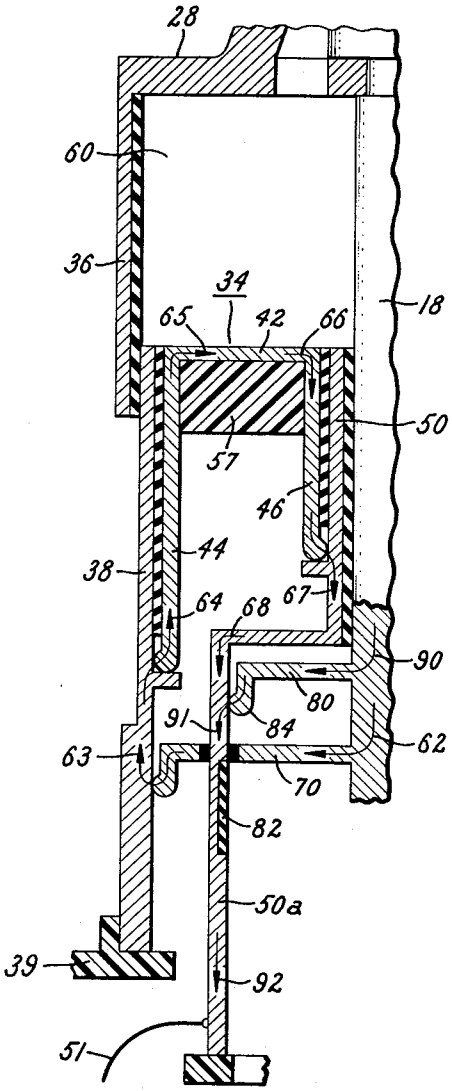
FIG. 2 is a sectional view of a portion of a modified interrupter, shown in the circuit-closed position.

This upward driving effect on the piston moves the piston upwardly with a force that varies directly with current magnitude and, more specifically, with the square of the current. This force is generally independent of the position of the piston as it moves through its stroke and does not, as in certain prior designs, sharply drop off as the piston is displaced from its initial position. FIG. 2 shows the piston in a position into which it has been driven by this force.

The above-described downward magnetic force on the bridging member 70 applies an accelerating downward force to the contact rod 18, which aids the circuit-breaker operating mechanism in driving the contact rod through its opening stroke. Since cylinder 28 is coupled to contact rod 18, this added downward force applied to contact rod 18 also aids in compressing the gas in cylinder space 60. Like the magnetic force on piston 34, the magnetic force on the bridging member 70 is generally independent of the position of the piston as it moves through its stroke.

In the embodiment of FIGS. 1 and 1A the magnetic forces for actuating the floating piston 34 and the bridging structure 70 are developed as soon as the current rises to the high value that calls for opening of the circuit breaker. FIGS. 2, 2A, and 2B illustrate a modified embodiment where the build-up of these magnetic forces is delayed until after a predetermined amount of contact-separation.

EMBODIMENT OF FIGS. 2, 2A, AND 2B

The embodiment of FIG. 2 generally corresponds to that of FIG. 1 except for an extra bridging member 80 on the contact rod 18 and an insulating portion 82 on the stationary legs 50*a* of the conductive support 50. Bridging member 80 carries sliding contacts 84 which engage the metal portions of legs 50*a* when the circuit interrupter is in its closed position of FIG. 2. When the circuit interrupter is in the closed position of FIG. 2, most of the current follows a path therethrough indicated by the arrows 90, 91, and 92.

When the circuit interrupter is closed, a relatively small portion of the total current follows the loop-shaped path depicted by arrows 62 through 68, which is the same loop-shaped path as described above with respect to FIG. 1. When the circuit interrupter is closed, current through this latter path is very low because this path has a substantially higher inductance and resulting impedance than the path depicted by arrows 90, 91, 92.

When the contact rod 18 is driven downwardly into its position of FIG. 2A during the initial portion of an opening operation, the sliding contacts 84 on bridging member 90 slide onto the insulating portion 82 of conductive legs 80*a*, thus interrupting further current flow through bridging member 80. As a result, substantially all the current that had been flowing via the path indicated by arrows 90 and 91 is transferred to the path indicated by arrows 62–68, after which the circuit interrupter performs as described hereinabove with respect to FIGS. 1 and 1A. More specifically, the magnetic force on piston 34 resulting from current following the arrows 62–68 drives the piston 34 upwardly from its position of FIG. 2A into its position of FIG. 2B, further compressing the gas in cylinder space 60. It will thus be apparent that in this embodiment, magnetic actuation of floating piston 34 is delayed until after a predetermined limited amount of opening travel of the contact rod 18.

EMBODIMENT OF FIGS. 3, 3A, AND 3B

Figure 3B:
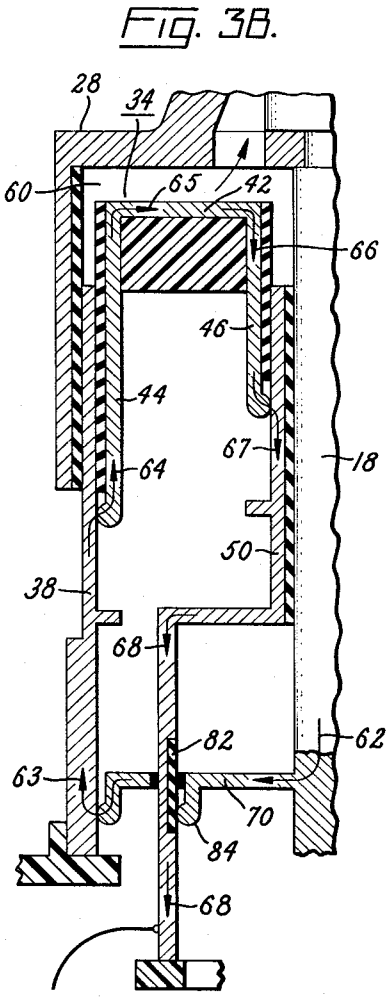
FIG. 3B shows the interrupter of FIG. 3 after additional contact-separating motion and after the floating piston has begun operation.
Figure 3A:
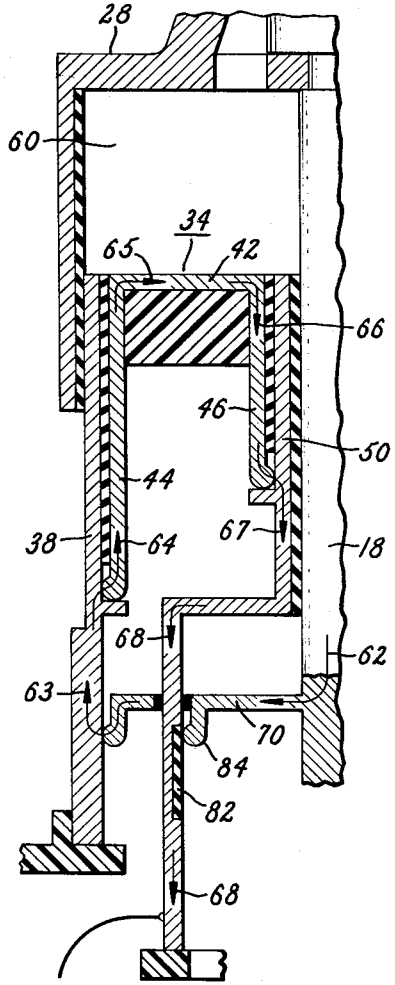
FIG. 3A shows the interrupter of FIG. 3 after initial contact-separating motion but prior to operation of its floating piston.
Figure 3:
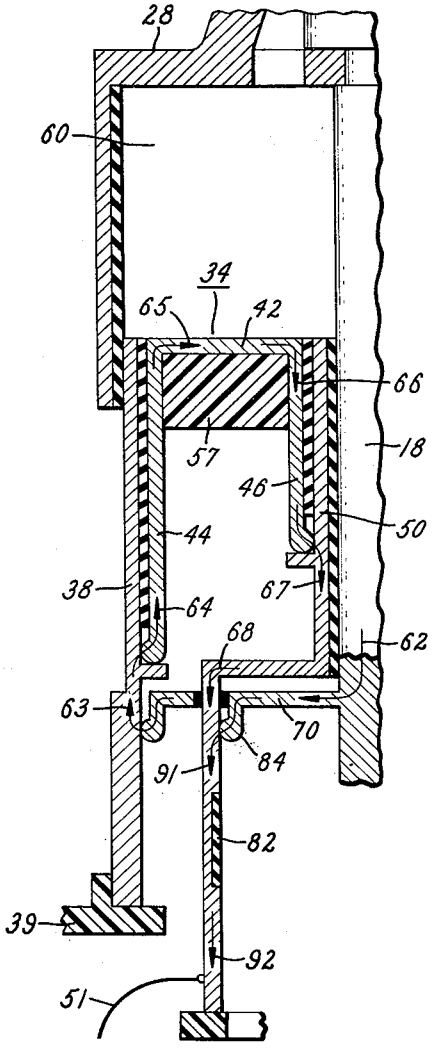
FIG. 3 shows still another modified embodiment of interrupter, shown in the circuit-closed position.

Another modified embodiment is depicted in FIGS. 3, 3A, and 3B. This embodiment operates in substantially the same manner as that of FIGS. 2 but differs from the embodiment of FIG. 2 in omitting one of the bridging members 80 of FIG. 2 and in including two sets of sliding contacts on the remaining bridging member 70. When the circuit interrupter is closed, most of the circuit interrupter current flows from bridging member 70 directly into conductive leg 50*a* via the first set of contacts 84, as indicated by arrow 91. This current bypasses the loop circuit indicated by arrows 63–68 of FIG. 3. But after a predetermined amount of contact-separating motion of contact rod 18, the sliding contacts 84 are moved onto the insulating portion 82, interrupting further current flow through the path of arrow 91 and transferring this current to the loop circuit indicated by arrows 62 through 68 of FIG. 3A. The magnetic effect of such current is to drive piston 34 upwardly into its position of FIG. 3B in the same manner as described with the embodiments of FIGS. 1 and 2.

EMBODIMENT OF FIGS. 4, 4A, AND 4B

Figure 4B:
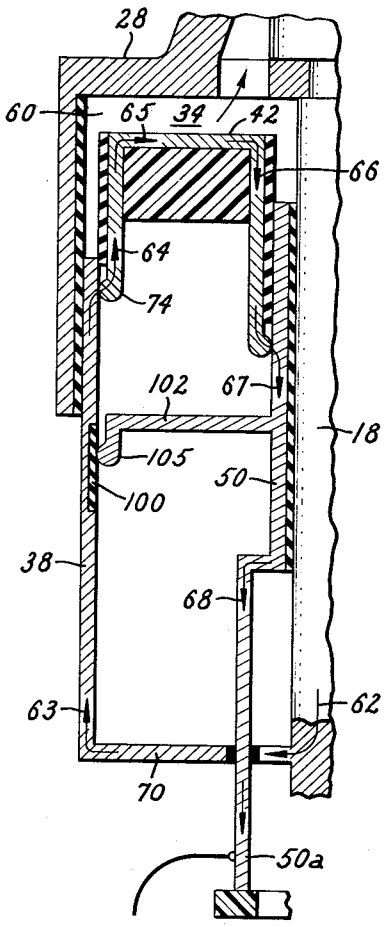
FIG. 4B shows the interrupter of FIG. 4 after additional contact-separating motion and after the floating piston has begun operation.
Figure 4A:
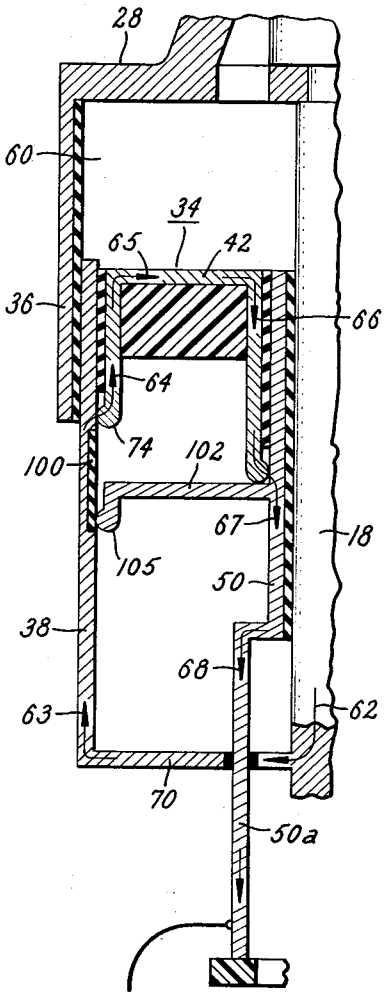
FIG. 4A shows the interrupter of FIG. 4 after initial contact-separating motion but prior to operation of its floating piston.
Figure 4:
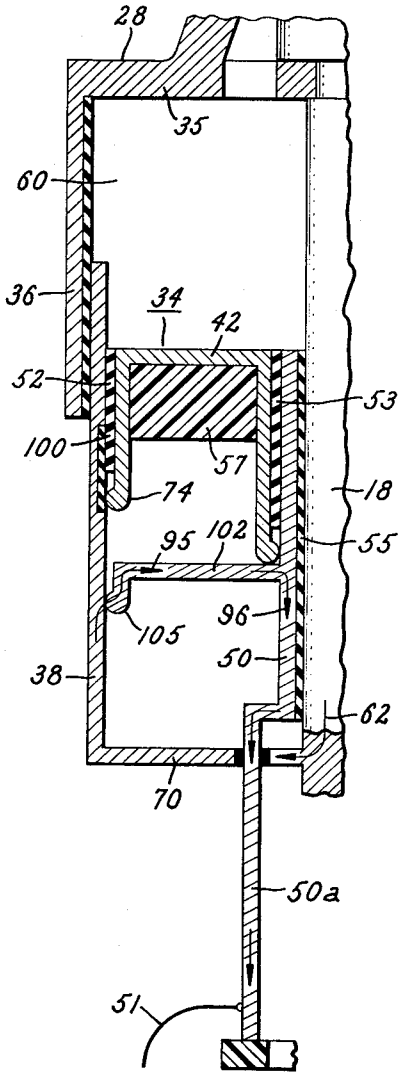
FIG. 4 shows still another modified embodiment of interrupter, illustrated in the circuit-closed position.

In the embodiments of FIGS. 2 and 3 the downward magnetic force acting on the bridging structure 70 is not effective until about the time the main current is transferred to the path through the piston 34. However, in another modified embodiment shown in FIGS. 4, 4A, and 4B this magnetic force on bridging structure 70 is developed at the start of the opening operation and prior to transfer of current to the piston 34. In this latter embodiment, the outer tubular housing 38 is coupled to the bridging structure 70 and has an insulating portion 100 that the sliding contacts 74 normally engage, as shown in FIG. 4. The conductive tubular support 50 carries a stationary bridging member 102 that carries sliding contacts 105 engaging the movable outer housing 38.

When the circuit interrupter of FIG. 4 is closed, the current therethrough, whether continuous or fault current, follows a path indicated by arrows 62, 95, and 96, thus bypassing piston 34 during this period. However, after a predetermined amount of downward opening travel by contact rod 18 and housing 38, the insulting portion 100 on housing 38 moves out of engagement with sliding contact 74 and into engagement with sliding contact 105, thus blocking current flow through stationary bridging member 102 and transferring the current previously flowing therethrough to the piston 34. Thereafter, the circuit breaker functions in generally the same manner as described hereinabove with respect to FIG. 1. That is, piston 34 is magnetically driven upwardly by the magnetic effect of current flowing through the loop-shaped path depicted by arrows 62 through 68 of FIG. 4A. It will thus be apparent that although in FIG. 4 there is a delay in application of magnetic force to the piston 34, magnetic force is immediately applied to bridging structure 70 to accelerate opening action, this latter magnetic force continuing until the circuit is interrupted.

EMBODIMENT OF FIGS. 5 AND 5A

Figure 5:
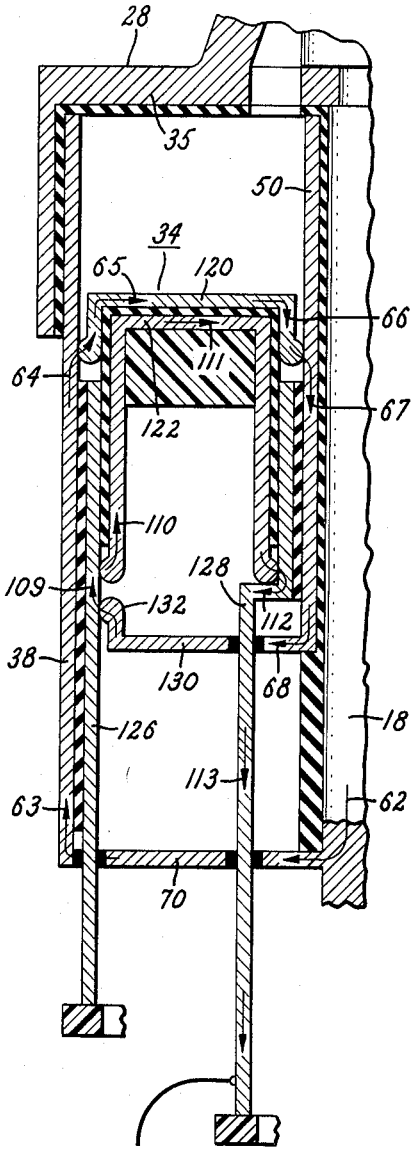
FIG. 5 shows a fifth embodiment of interrupter, illustrated in the circuit-closed position.
Figure 5A:
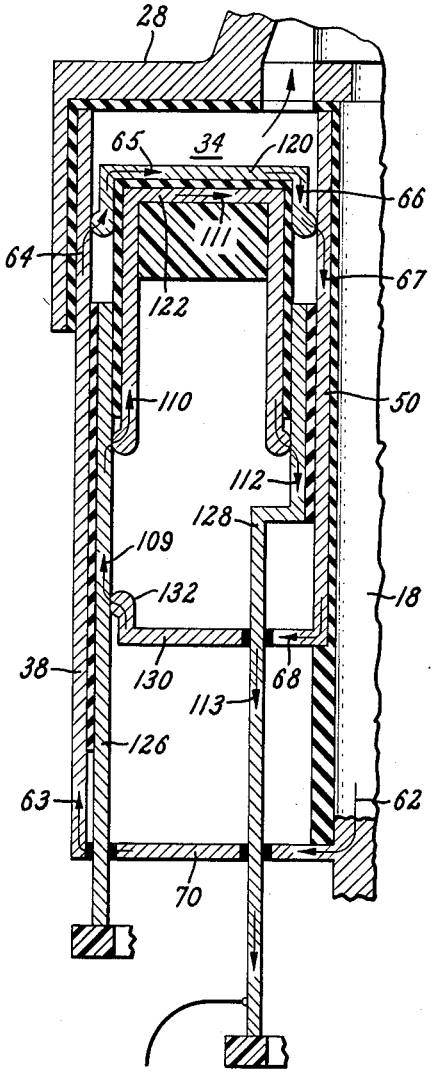
FIG. 5A shows the interrupter of FIG. 5 after a portion of an opening operation.

In FIGS. 5 and 5A, there is shown still another embodiment of the invention. In this embodiment, the loop circuit comprises, in effect, 2½ turns instead of the 1½ turns of the other embodiments. In the embodiment of FIGS. 5 and 5A, current follows the path depicted by the arrows 62 through 68 in sequence (for 1½ turns) and arrows 109 through 113 in sequence (for an additional turn). By including the additional turn in this loop circuit, higher magnetic forces can be developed on the floating piston 34 when a given value of current flows through the loop circuit.

In the loop circuit of FIG. 5, the lower bridging member 70 is fixed to the outer housing 38 and the movable contact rod 18; and the outer housing 38 and the movable contact rod 18; and the outer housing 38 is fixed to the movable contact rod 18 and cylinder 28 for movement therewith. Piston 34 comprises two inter-nesting sections 120 and 122 locally insulated from each other. Section 120 is electrically connected between housing 38 and inner support 50. Section 122 is electrically connected between a secondary tubular outer housing 126 and a secondary tubular support 128. Sliding contacts are provided between piston section 120 and parts 38 and 50 and between piston section 122 and parts 126 and 128. The secondary outer housing 126 is locally insulated from main outer housing 38; and the secondary support 128 is locally insulated from main tubular support 50. Additional bridging structure 130 extends between support 50 and secondary outer housing 126, carrying sliding contacts 132 at its outer end for engaging housing 126. It will be apparent that this structure forces the circuit interrupter current to follow the paths depicted by arrows 62 through 68 and 109 through 113 in sequence. In following this path, the current flows three times through the inner conductor (via parts 18, 50, and 128, respectively), two times through the outer conductor (via parts 38 and 126, respectively), and twice through the radial path defined by piston 34 (via parts 120 and 122, respectively). Current through this loop circuit develops a magnetic force on the piston approximately three times that developed by the same value of current in the other embodiments.

GENERAL DISCUSSION

In all of these embodiments the magnetic force on the piston varies as a direct function of the current (and, more particularly, the square of the current) through the loop-shaped circuit. The pressure developed in cylinder space 60 by this magnetic force on the piston will slightly lag the magnetic force by a time delay period depending upon the mass of the piston. By appropriately choosing this mass, the delay period can be made approximately equal to one-fourth cycle of power frequency current, thus usually causing the maximum pressure to develop at about the instant of a natural current zero. This is the instant when the pressure is most effective in assuring that the arc will remain extinguished and not re-ignite immediately following natural current zero.

EMBODIMENT OF FIG. 6

Figure 6:
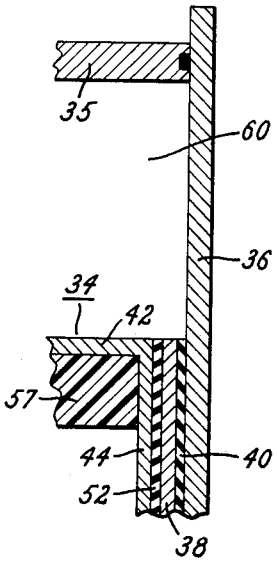
FIG. 6 shows still another modified form of the interrupter.

In all of the above-described illustrated embodiments the end wall 35 of the cylinder 28 is integral with the cylindrical portion 36 of the cylinder. While this is a preferred construction, another satisfactory design that performs in essentially the same way is shown in FIG. 6. Here the cylindrical portion 36 is a stationary member and the end wall 35 is movable in the manner of a piston with respect to cylindrical portion 36. Although relative movement is intended between parts 35 and 36 of FIG. 6, part 35 may still be thought of as the end wall of the cylinder 28. The floating piston 34 operates within this cylinder in the same way as described in connection with FIG. 1.

EMBODIMENT OF FIG. 7

Figure 7:
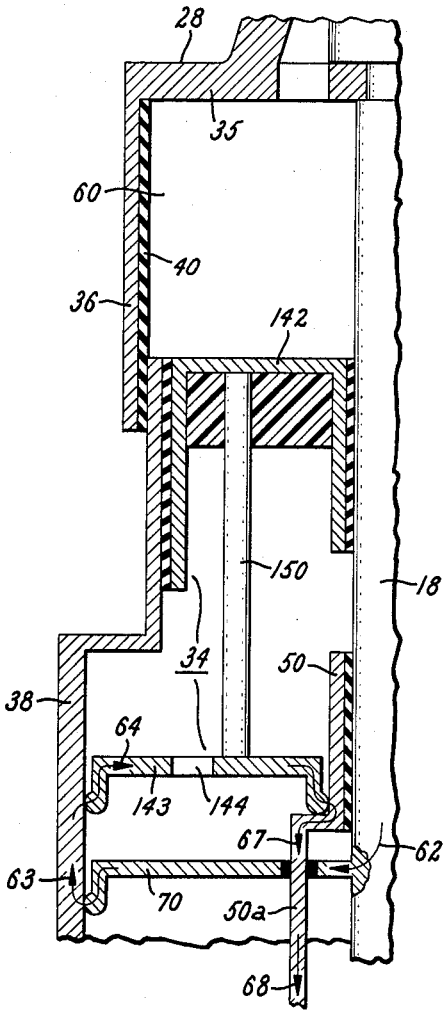
FIG. 7 shows still another modified form of the interrupter.

The embodiment of FIG. 7 is essentially the same as that shown in FIG. 1 except that the floating piston 34 instead of comprising a single section (42–46, as in FIG. 1) that performs both pumping and current-carrying functions is divided into two separate sections 142 and 143, the first of which performs the pumping function and the second of which performs the current-carrying function. These two sections 142 and 143 are mechanically connected together by a plurality of tie rods such as shown at 150. Current through the interrupter follows the path indicated by arrows 62–68, which extends through the piston 34 via the second section 143 only. This current develops an upward force on current-carrying section 143 varying directly with the square of the current through this path. This force is applied to the pumping section 142 through tie rods 150. When the current through path 62–68 exceeds a predetermined value, the lower piston section 143 moves upwardly, driving the upper piston section 142 ahead of it and causing the upper piston section to compress the gas in space 60. It will be apparent from this modification that I am not limited by the size of the pumping section (142) as to how much pumping force can be developed on the floating piston. This force varies directly in accordance with the radiums of the current-carrying section 143, and this radius can be selected to provide the required force without changing the radius of pumping section 142. It is to be noted that lower piston section 143 contains holes 143 to assure that the pressure on its opposite sides is substantially equal.

While I have shown and described particular embodiments of my invention, it will be obvious to those skilled in the art that various changes and modifications may be made without departing from my invention in its broader aspects; and I, therefore, intend in the appended claims to cover all such changes and modifications as fall within the true spirit and scope of my invention.

What I claim as new and desire to secure by Letters Patent of the United States is:

1. In a puffer-type electric circuit interrupter:

a. a pair of separable contacts, b. a movable conductive rod electrically connected to and mechanically coupled to one of said contacts, c. means for transmitting contact-separating force to said conductive rod, d. a cylinder having an end wall coupled to said conductive rod, e. a piston located within said cylinder and relatively movable with respect to said cylinder for pressurizing fluid within said cylinder when said piston is moved relative to said end wall in a direction toward said end wall, f. means for conveying pressurized fluid from said cylinder to the space between said contacts upon contact-separation to aid in extinguishing arcs formed between said contacts, g. first tubular conductive structure surrounding said conductive rod, h. second tubular conductive structure surrounding said first tubular conductive structure and said conductive rod, i. said piston having a portion forming an electrical connection between said first and second tubular conductive structures and being movable with respect to said first and second tubular conductive structures, j. conductive bridging structure extending between and electrically interconnecting said conductive rod and said second tubular conductive structure, k. means effective during a contact-separating operation for forcing current flowing through said conductive rod to follow a loop-shaped path that extends in series through said rod, said bridging structure, said second tubular conductive structure, said piston portion, and said first tubular conductive structure, with the instantaneous current in said path flowing through said first tubular structure and said rod in a first direction longitudinally of said rod and flowing through said second tubular structure in a second direction longitudinally of said rod which is generally opposite to said first direction, l. the magnetic effect of current through said loop-shaped path via said piston portion acting to drive said piston toward said cylinder end wall, thereby pressurizing fluid within said cylinder.

2. The interrupter of claim 1 in which most of the current through said conductive rod follows said loop-shaped path during the entire interrupting operation.

3. The interrupter of claim 1 in combination with:

a. means defining, when said current interrupter is closed and during the early stages of an opening operation, a second current path bypassing the portion of said loop-shaped current path passing through said piston portion, and b. means effective after a predetermined initial contact-separating travel of said conductive rod for transferring most of the current in said second path of the portion of said loop-shaped path extending through said piston portion.

4. The interrupter of claim 1 in combination with:

a. means preventing most of said current from following the portion of said loop-shaped path extending through said piston portion while the circuit interrupter is closed and during the early stages of an opening operation, thus limiting the magnetic force on said piston to a relatively low level during this period, and b. means for forcing most of said current to pass through said loop-shaped path, including said piston portion, after a predetermined initial contact-separating travel of said conductive rod, thus increasing the magnetic force on said piston after said initial contact-separating travel.

5. The interrupter of claim 1 in which:

a. said conductive bridging structure is mechanically coupled to said conductive rod, and b. the magnetic effect of current through said loop-shaped path acts to drive said bridging structure and said rod in a contact-separating direction.

6. The interrupter of claim 2 in which a. said conductive bridging structure is mechanically coupled to said conductive rod, and b. the magnetic effect of current through said loop-shaped path acts to drive said bridging structure and said rod in a contact-separating direction.

7. The interrupter of claim 3 in which:

a. said conductive bridging structure is mechanically coupled to said conductive rod, and b. the magnetic effect of current through said second current path of claim 3 acts to drive said bridging structure and said rod in a contact-separating direction.

8. The interrupter of claim 4 in which:

a. said conductive bridging structure is mechanically coupled to said conductive rod, and b. the magnetic effect of current through said loop-shaped path acts to drive said bridging structure and said rod in a contact-separating direction.

9. The interrupter of claim 4 in which:

a. said conductive bridging structure is mechanically coupled to said conductive rod, b. the magnetic effect of current through said loop-shaped path acts to drive said bridging structure and said rod in a contact-separating direction, and c. means is provided for causing most of said current to flow through a portion of said loop-shaped circuit including said bridging member during the early stages of an opening operation so as to develop magnetic force for driving said bridging member and said conductive rod in a contact-separating direction during said initial stages.

10. The interrupter of claim 1 in which:

a. the structure referred to in (d) of claim 1 defines one turn of said loop-shaped path, b. additional structure is provided for defining an additional turn of said loop-shaped path extending for a second time through said piston via another portion of the piston, and c. The magnetic effect of current through said additional turn via said other piston portion also acts to drive said piston toward said cylinder end wall, thus providing additional force for pressurizing fluid within said cylinder.

11. The interrupter of claim 1 in which said portion of the piston through which said loop-shaped path extends is located closely adjacent the fluid that is pressurized in said cylinder by piston motion.

12. The interrupter of claim 1 in which:

a. said piston comprises two sections, a first one of which is located closely adjacent the fluid that is pressurized by piston motion and a second one of which is spaced from said first section, and means for mechanically coupling said two sections together, b. said second section constitutes the piston portion of claim 1 through which said loop-shaped path extends.

13. The interrupter of claim 12 in which said second piston section has a larger outer diameter than said first piston section.

* * * * *